US011621522B2

(12) United States Patent
Kneevers

(10) Patent No.: US 11,621,522 B2
(45) Date of Patent: Apr. 4, 2023

(54) GUIDE ROD ASSISTED ELECTRICAL QUICK CONNECT DEVICE

(71) Applicant: Chris Kneevers, Ontario, CA (US)

(72) Inventor: Chris Kneevers, Ontario, CA (US)

( * ) Notice: Subject to any disclaimer, the term of this patent is extended or adjusted under 35 U.S.C. 154(b) by 331 days.

(21) Appl. No.: 17/109,357

(22) Filed: Dec. 2, 2020

(65) Prior Publication Data

US 2022/0173549 A1 Jun. 2, 2022

(51) Int. Cl.
*H01R 13/631* (2006.01)
*H01R 13/422* (2006.01)

(52) U.S. Cl.
CPC ..... *H01R 13/631* (2013.01); *H01R 13/4223* (2013.01)

(58) Field of Classification Search
CPC .. H01R 13/631; H01R 13/4223; H01R 13/60; H01R 13/62; H01R 13/443; H01R 43/26
USPC ..... 439/362, 378, 342, 310
See application file for complete search history.

(56) References Cited

U.S. PATENT DOCUMENTS 1,158,708 A * 11/1915 Mulligan ..... H01R 13/443 439/148
4,850,890 A * 7/1989 Kuzuno ..... H01R 24/76 439/314
5,769,555 A * 6/1998 Okada ..... H01R 13/4365 439/378
6,428,341 B2 * 8/2002 Kinezuka ..... H01R 13/6275 439/310
6,652,309 B2 * 11/2003 Sukagawa ..... H01R 12/79 439/376
8,425,250 B2 * 4/2013 Kagotani ..... H01R 12/7005 439/680
11,223,155 B1 * 1/2022 Marquez ..... H01R 13/443
2016/0013585 A1 * 1/2016 Rossman ..... H01R 13/6215 439/378

FOREIGN PATENT DOCUMENTS

GB 2598394 A * 3/2022 ..... E21B 33/038
KR 20170142636 A * 12/2017

* cited by examiner

*Primary Examiner* — Marcus E Harcum
(74) *Attorney, Agent, or Firm* — Pharar Patents & Intellectual Property; Andrew A. Pharar

(57) ABSTRACT

The guide rod assisted electrical quick connect device disclosed herein may allow a user to first advance an electrical lead into an exterior wall, and then advance that lead through multiple interior layers of the wall without utilizing additional components. The lead may comprise a quick-connect fishing tool that may be attached to a quick-connect connector attached to the signage, and the fishing tool may then be quickly removed and replaced by a quick-connect connector that is attached to the power source. The connector attached to the signage may be a male connector, and the connectors attached to the fishing tool and power source may be female connectors, or vice versa, so as to facilitate the spirit of the present invention. The design of the present invention may both simplify and reduce the time required to install signage, as compared to techniques known in the art.

9 Claims, 7 Drawing Sheets

GUIDE ROD ASSISTED ELECTRICAL QUICK CONNECT DEVICE

TECHNICAL FIELD OF THE INVENTION

The present invention relates in general to electrical connectors, and, more specifically, to a guide rod assisted electrical quick connect device.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Signage is the design and application of signs and logos to, generally, identify a place or convey a message. Signs may be used, for example, to identify highways and interchanges, or to label places and notable locations for advertising and identification purposes. In the signage industry, commercial and industrial locations nearly always install a sign to identify who or what operates out of a particular location. Such a sign may be installed, for example, near the major roadway accessing a particular strip mall, on the doors or windows of the storefront itself, or over the storefront on an exterior wall.

The type and composition of signage used may vary significantly based on the location of its installation. Signage installed near a major roadway accessing a strip mall, for example, may comprise a relatively large housing in which multiple clear or opaque plastic inserts may be installed and lighted by a central lighting mechanism. Signage installed on the doors or windows of a particular location, on the other hand, may comprise vinyl or plastic lettering and logos cut out and applied directly to the glass surfaces. Signage installed on an exterior wall, in contrast, generally comprises separate, custom made, and self-contained sections that, in the collective, create the artwork or logo desired.

The type of signage installed on an exterior wall of a particular location generally comprises one or more housings implementing neon tubes or, more modernly, light-emitting diode (LED) chains installed within a shaped housing and covered by an appropriately-colored plastic layer. The installation of such housings generally requires that the housing be mounted to the exterior wall by installing anchor points to which the housing may attach, and further drilling through the exterior wall to allow for the passage of electrical wiring, that may power the lights of the housing, into the interior of the structure for connection to a dedicated power source.

The problem with current technologies known in the art, though, arises out of the common scenario in which a hole must be drilled into an exterior wall to allow the electrical connection to pass, and an installer must then access the rear aspect of the wall to connect the electrical connection to a dedicated power source. Often such exterior walls comprise an outermost layer and one or more inner layers, having a space interposed between them, and into which space may be a hollow opening or a plurality of insulating materials.

In the current art an installer must first splice a lead from the signage and advance this lead into the hole drilled in the outer wall, and then attempt to advance this lead through any hollow spaces, insulation, or additional walls until they are able to access the same lead from the interior side of the wall. Such a solution results, often, in the lead being lost in the insulation or any openings, requiring extra effort by the installer to advance each lead into the interior space where multiple layers of wall exist. The present device provides a solution to this problem by providing a guide wire and a series of quick-splice and quick-connect components that significantly reduce the amount of time required to install, advance, and finally connect the leads for all types of electrical signage.

Thus, there is a need in the art for a guide rod assisted electrical quick connect device that may allow a user to first advance an electrical lead into an exterior wall, and then advance that lead through multiple interior layers of the wall without utilizing additional components. The lead may comprise a quick-connect fishing tool that may be attached to a quick-connect connector attached to the signage, and the fishing tool may then be quickly removed and replaced by a quick-connect connector that is attached to the power source. The connector attached to the signage may be a male connector, and the connectors attached to the fishing tool and power source may be female connectors, or vice versa, so as to facilitate the spirit of the present invention. The design of the present invention may both simplify and reduce the time required to install signage, as compared to techniques known in the art. It is to these ends that the present invention has been developed.

BRIEF SUMMARY OF THE INVENTION

To minimize the limitations in the prior art, and to minimize other limitations that will be apparent upon reading and understanding the present specification, the present invention describes a guide rod assisted electrical quick connect device.

It is an objective of the present invention to provide a guide rod assisted electrical quick connect device that may comprise a first connector assembly.

It is another objective of the present invention to provide a guide rod assisted electrical quick connect device that may comprise a male connector assembly.

It is another objective of the present invention to provide a guide rod assisted electrical quick connect device that may comprise a first main body.

It is another objective of the present invention to provide a guide rod assisted electrical quick connect device that may comprise a first main body electrical connection mechanism.

It is another objective of the present invention to provide a guide rod assisted electrical quick connect device that may comprise a second connector assembly.

It is another objective of the present invention to provide a guide rod assisted electrical quick connect device that may comprise a fishing tool assembly.

It is another objective of the present invention to provide a guide rod assisted electrical quick connect device that may comprise a plurality of guide rods.

It is another objective of the present invention to provide a guide rod assisted electrical quick connect device that may comprise a set screw.

It is another objective of the present invention to provide a guide rod assisted electrical quick connect device that may comprise a third connector assembly.

It is another objective of the present invention to provide a guide rod assisted electrical quick connect device that may comprise a female connector assembly.

It is another objective of the present invention to provide a guide rod assisted electrical quick connect device that may comprise a third main body.

It is another objective of the present invention to provide a guide rod assisted electrical quick connect device that may comprise a third main body electrical connection mechanism.

It is another objective of the present invention to provide a guide rod assisted electrical quick connect device that may comprise a plurality of quick-connect connections.

It is another objective of the present invention to provide a guide rod assisted electrical quick connect device that may comprise a plurality of third main bodies on an electrical spool.

It is another objective of the present invention to provide a guide rod assisted electrical quick connect device that may comprise an insulating seal.

It is another objective of the present invention to provide a guide rod assisted electrical quick connect device that may comprise a resilient material of construction.

It is another objective of the present invention to provide a guide rod assisted electrical quick connect device that may comprise a water-proof material of construction.

It is another objective of the present invention to provide a guide rod assisted electrical quick connect device that may comprise a reusable material of construction.

It is another objective of the present invention to provide a guide rod assisted electrical quick connect device that may comprise a multi-component construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Figure 1:
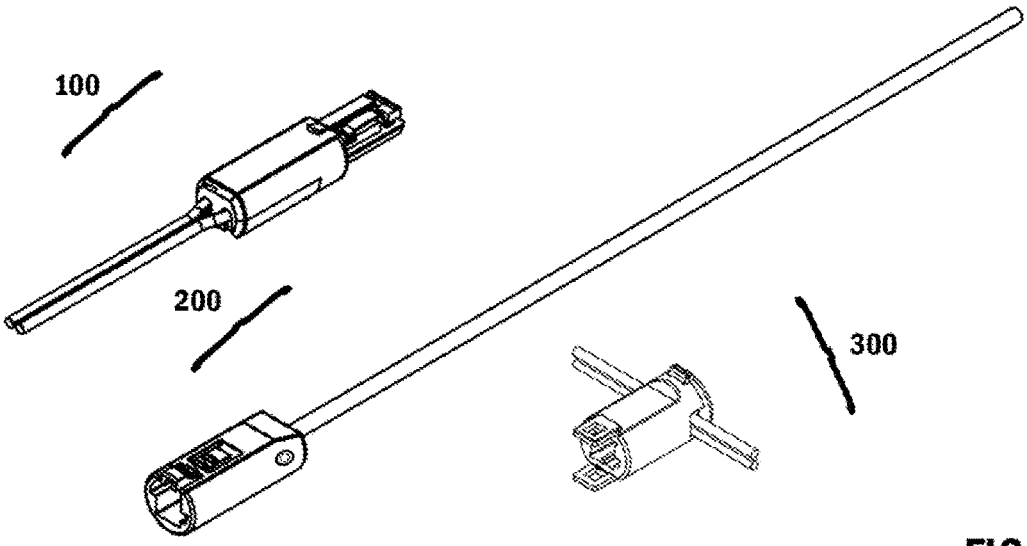
FIG. 1 is an isometric perspective view of a plurality of components of a guide rod assisted electrical quick connect device, as contemplated by the present disclosure.

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The guide rod assisted electrical quick connect device disclosed herein may allow a user to first advance an electrical lead into an exterior wall, and then advance that lead through multiple interior layers of the wall without utilizing additional components. The lead may comprise a quick-connect fishing tool that may be attached to a quick-connect connector attached to the signage, and the fishing tool may then be quickly removed and replaced by a quick-connect connector that is attached to the power source. The connector attached to the signage may be a male connector, and the connectors attached to the fishing tool and power source may be female connectors, or vice versa, so as to facilitate the spirit of the present invention. The design of the present invention may both simplify and reduce the time required to install signage, as compared to techniques known in the art.

The illustrations of FIGS. 1-11 illustrate a guide rod assisted electrical quick connect device, as contemplated by the present disclosure. The device may comprise, generally, a male connector assembly 100, a fishing tool assembly 200, and a female connector assembly 300. The male connector assembly 100 may further comprise a connection sender 114, which may be any appropriate connection sender, and the fishing tool assembly 200 and female connector 300 may each comprise a connection receiver 212 that is compatible with and complementary to the connection sender 114. In this way the male connector assembly 100 may be reversibly connected to the fishing tool assembly 200 or, alternatively, may be reversibly connected to the female connector assembly 300.

Figure 2:
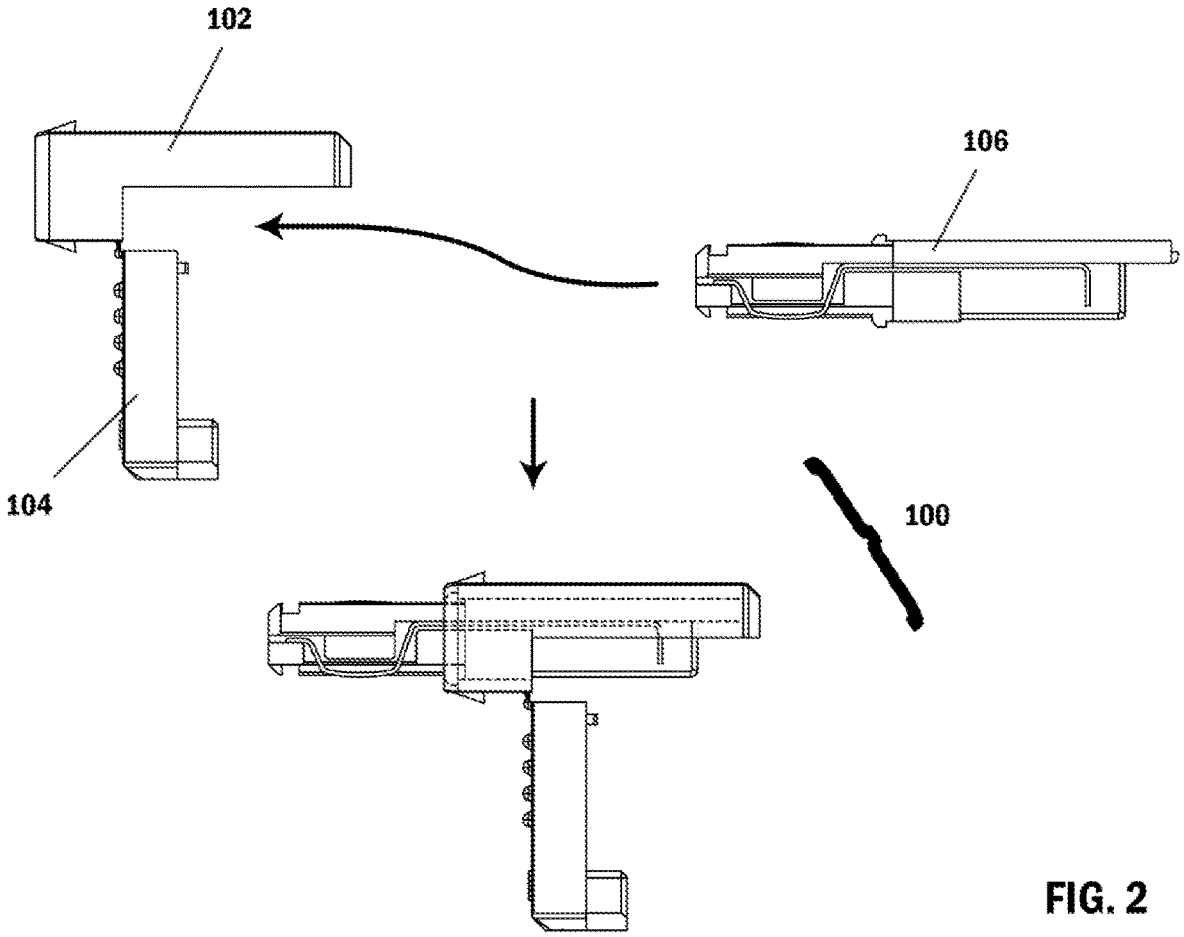
FIG. 2 is a side elevation perspective view of a first connector assembly of a guide rod assisted electrical quick connect device, as contemplated by the present disclosure.
Figure 3:
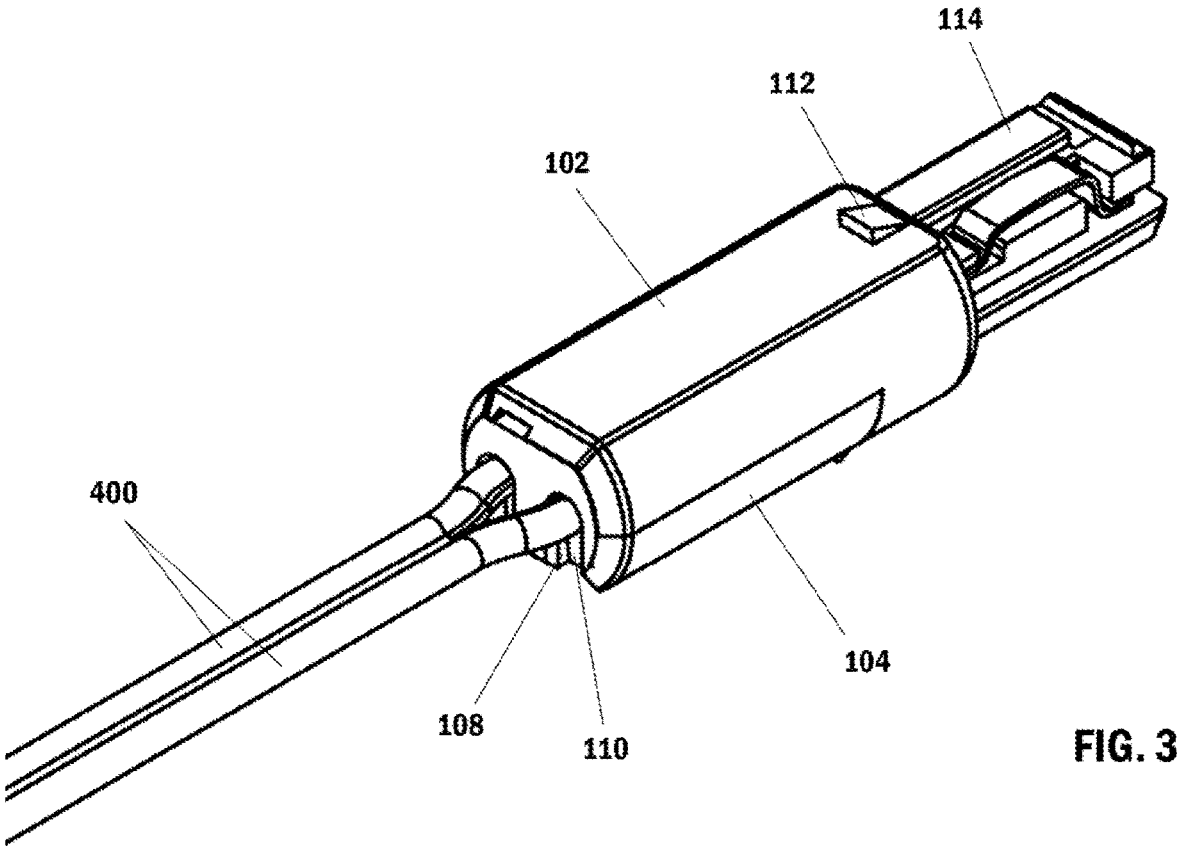
FIG. 3 is an isometric perspective view of a first connector assembly of a guide rod assisted electrical quick connect device, as contemplated by the present disclosure.

The illustrations of FIGS. 2-3 illustrate a male connector assembly 100, which may comprise a main body 102 having a body lid 104 generally forming an outer shell into which may be installed a contact body 106. The contact body 106 may comprise the electrical components and connections necessary to create an electrical plug having a connection sender 114, and may be electrically attached to a power consumer by consumer-side electrical wiring 400.

The consumer-side electrical wiring 400 may comprise, for example, a pair of electrical wires carrying either a power signal or a ground signal towards or away from the male connector assembly 100.

The main body 102 of the male connector assembly 100 may further comprise a plurality of wiring slots 108 into which one each of the electrical wires of the consumer-side electrical wiring 400 may be inserted. The body lid 104 of the male connector assembly 100 may comprise a plurality of wiring blades 110 that may align with the plurality of wiring slots 108 in such a way that one each of the plurality of wiring blades 110 splices into one each of the electrical wires inserted into one each of the plurality of wiring slots 108. The plurality of wiring blades 110 may further be electrically attached to the contact body 106.

By this design the placing of electrical wires into the plurality of wiring slots 108 and the closing of the body lid 104 of the male connector assembly 100 against the main body 102 of the male connector assembly 100 creates a continuous electrical connection between the male connector assembly 100, the consumer-side electrical wiring 400, and a power consumer. This self-splicing design eliminates the need for a user to first strip the electrical wires before attached them to the male connector assembly 100, reducing the time requirement and complexity of installing the male connector assembly 100.

The male connector assembly 100 may further comprise a mechanism for reversibly connecting it to the fishing tool assembly 200 or the female connector assembly 300 and preventing unintended separation of the connected components. By way of example, the male connector assembly 100 may further comprise a connector lock 112, which may be one or more projections on the outer side of the main body 102 of the male connector assembly 100 onto which an appropriate notch, hook, clamp, or other attachment mechanism may be engaged by pushing two connectors towards each other, and which prevents the attachment mechanism from becoming separated without an intentional unlocking of the attachment mechanism by a user.

The male connector assembly 100 may further comprise a plurality of finger traction devices on its outer surface to aid a user in pushing, pulling, or squeezing the male connector assembly 100. In one embodiment a squeezing of the male connector assembly 100 may aid in disconnecting the connector lock 112 from an attachment mechanism on a second connector.

Figure 4:
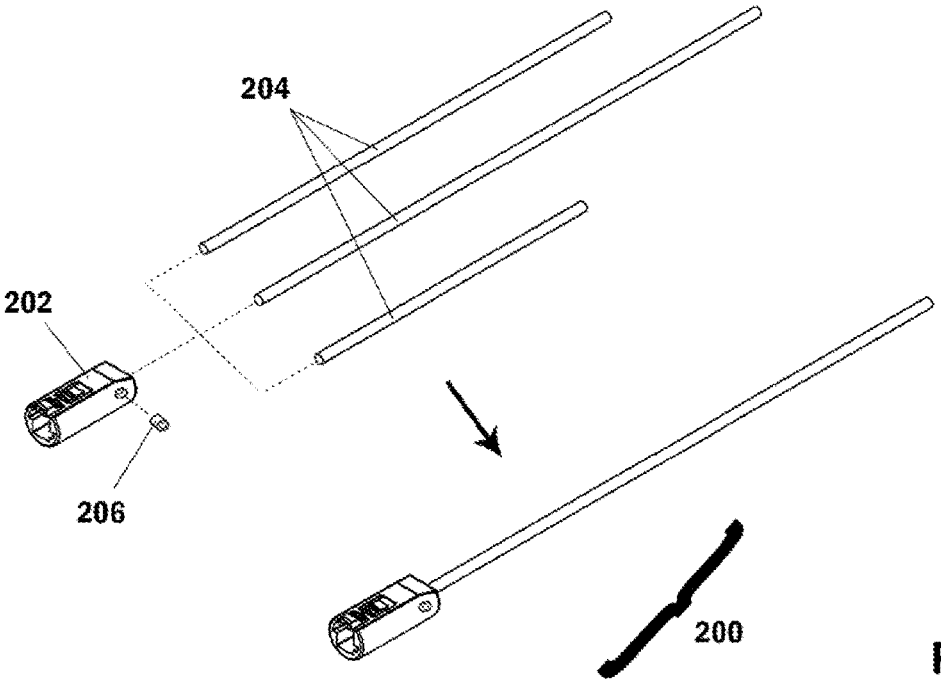
FIG. 4 is an isometric perspective view of a plurality of guide rods attached to a second connector assembly of a guide rod assisted electrical quick connect device, as contemplated by the present disclosure.
Figure 5:
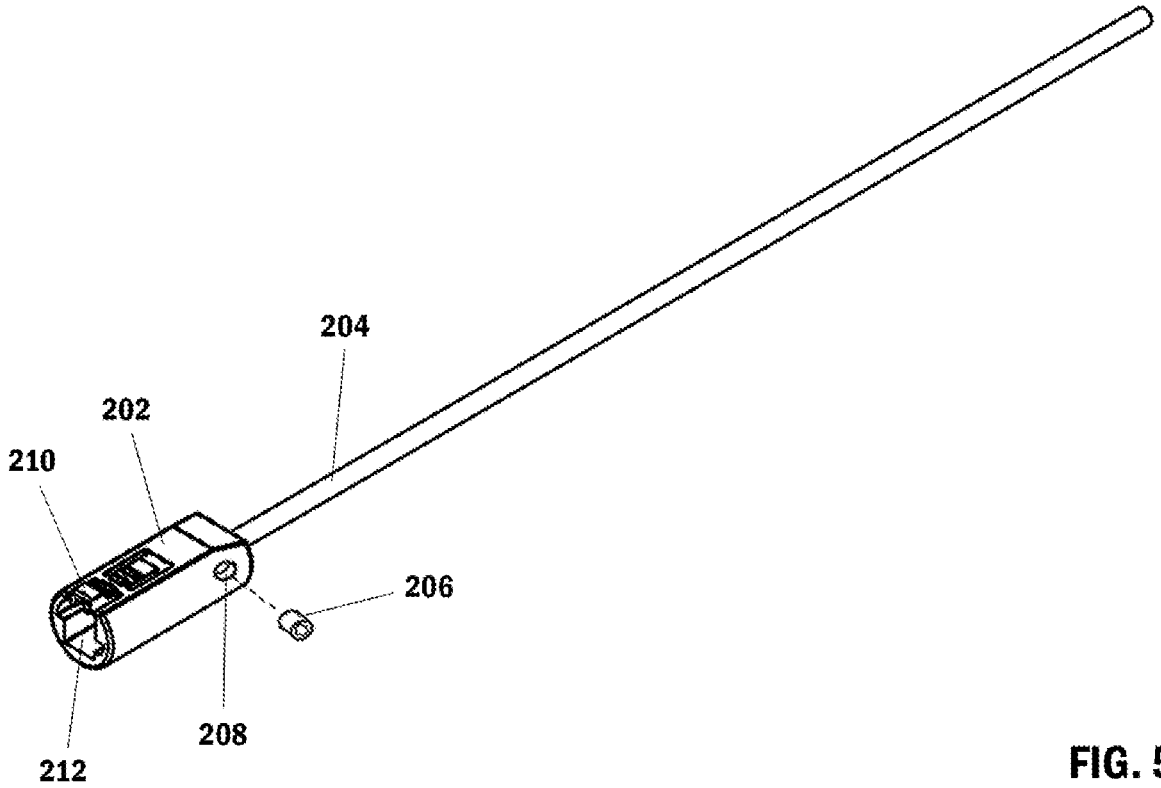
FIG. 5 is an isometric perspective view of a second connector assembly of a guide rod assisted electrical quick connect device, as contemplated by the present disclosure.

The illustrations of FIGS. 4-5 illustrate a fishing tool assembly 200, which may comprise a main body 202 having a guide rod receiver (not shown), a set screw receiver 208, and a connection receiver 212. The guide rod receiver may comprise a generally cylindrical opening on a front face of the main body 202 of the fishing tool assembly 200 into which one of a plurality of guide rods 204 may be inserted.

The plurality of guide rods 204 may comprise, generally, solid cylindrical rods of varying length ranging from six (6) inches to twenty-four (24) inches that may be interchanged depending on the needs of the user. A user may select an appropriate length one of the plurality of guide rods 204 and place it within the guide rod receiver. The set screw receiver 208, which may comprise a threaded cylindrical opening on a side face of the main body 202 of the fishing tool assembly 200, may open onto the guide rod receiver such that a set screw 206 may be advanced into the set screw receiver 208 and may contact the one of the plurality of guide rods 204 installed, locking it in place by mechanical friction and pressure.

The fishing tool assembly 200 may further comprise a mechanism for reversibly connecting it to the male connector assembly 100 and preventing unintended separation of the connected components. By way of example, the fishing tool assembly 200 may further comprise a connector notch 210, which may be one or more notches, hooks, clamps, or other attachment mechanisms on the outer side of the main body 202 of the fishing tool assembly 200 which may attach onto the connector lock 112 of the male connector assembly 100 by pushing the two connectors towards each other, and which prevents the attachment mechanism from becoming separated without an intentional unlocking of the attachment mechanism by a user.

The fishing tool assembly 200 may further comprise a connection receiver 212, which may be an opening in the main body 202 of the fishing tool assembly 200 that is compatible with and complementary to the connection sender 114 of the male connector assembly 100 and receives the connection sender 114 of the male connector assembly 100.

The fishing tool assembly 200 may further comprise a non-electrical component, such that there is no electrical continuity between the fishing tool assembly 200 and the male connector assembly 100 when they are connected to each other.

The fishing tool assembly 200 may further comprise a plurality of finger traction devices on its outer surface to aid a user in pushing, pulling, or squeezing the fishing tool assembly 200. In one embodiment a squeezing of the fishing tool assembly 200 may aid in disconnecting the connector notch 210 from an attachment mechanism on a second connector.

Figure 6:
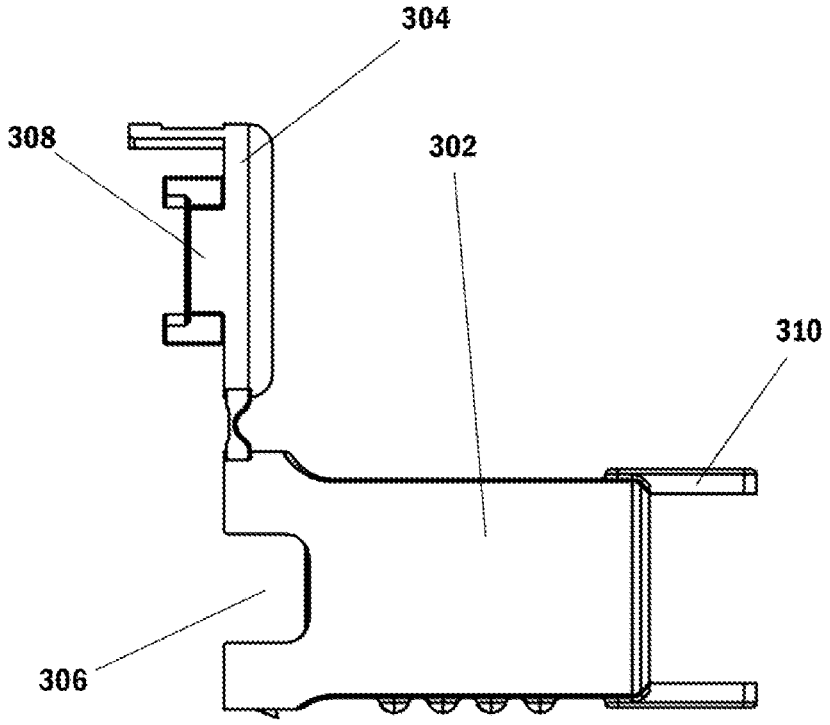
FIG. 6 is a side elevation perspective view of a third connector assembly of a guide rod assisted electrical quick connect device, as contemplated by the present disclosure.
Figure 7:
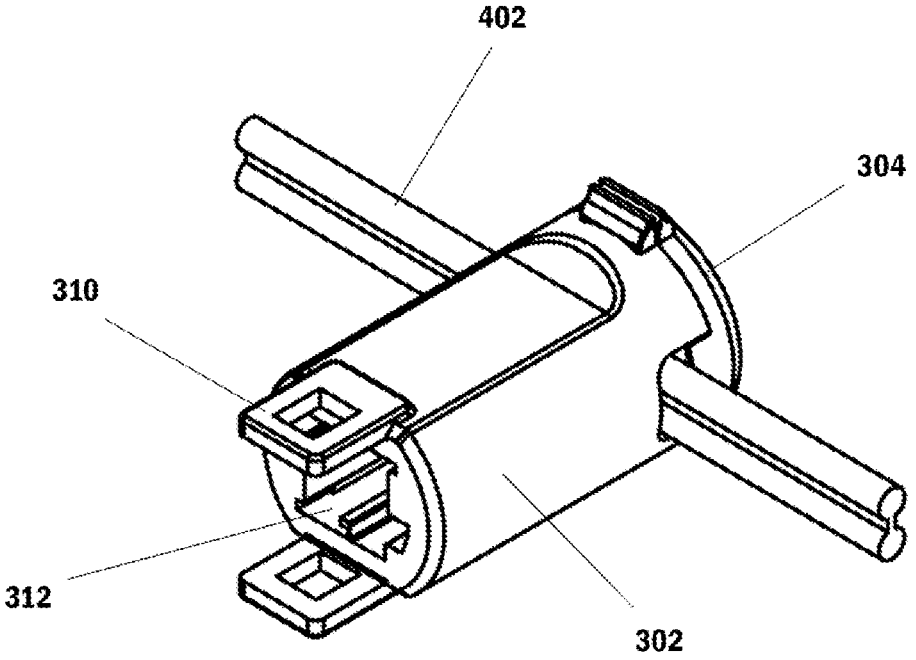
FIG. 7 is an isometric perspective view of a third connector assembly of a guide rod assisted electrical quick connect device, as contemplated by the present disclosure.
Figure 8:
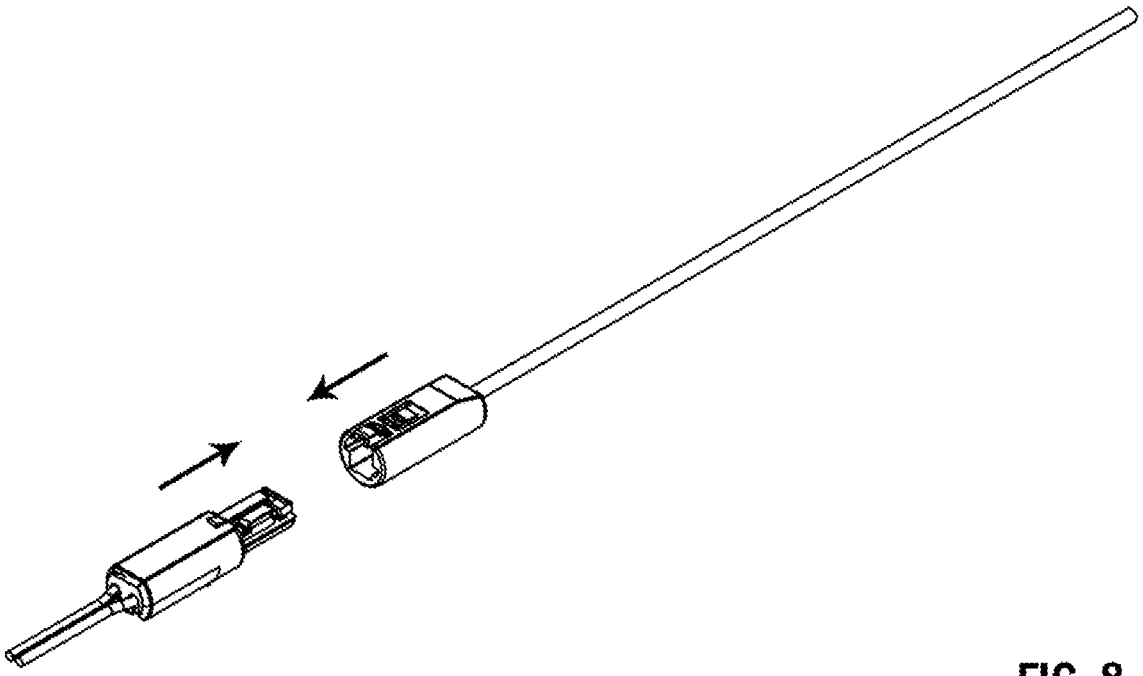
FIG. 8 is an isometric perspective view of a first step for using a guide rod assisted electrical quick connect device, as contemplated by the present disclosure.
Figure 9A:
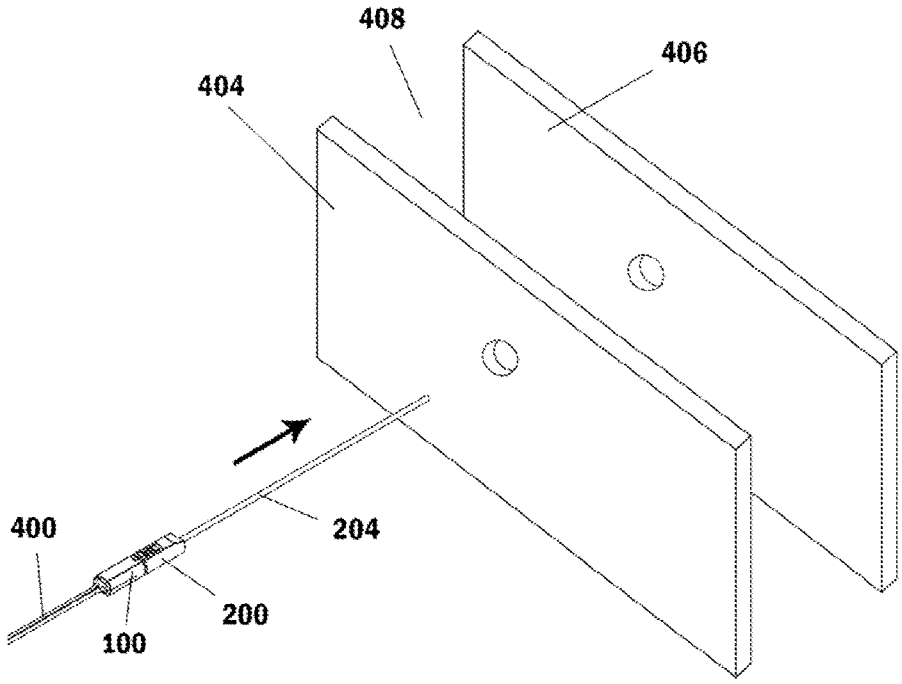
FIG. 9*a* is an isometric perspective view of a second step for using a guide rod assisted electrical quick connect device, as contemplated by the present disclosure.
Figure 9B:
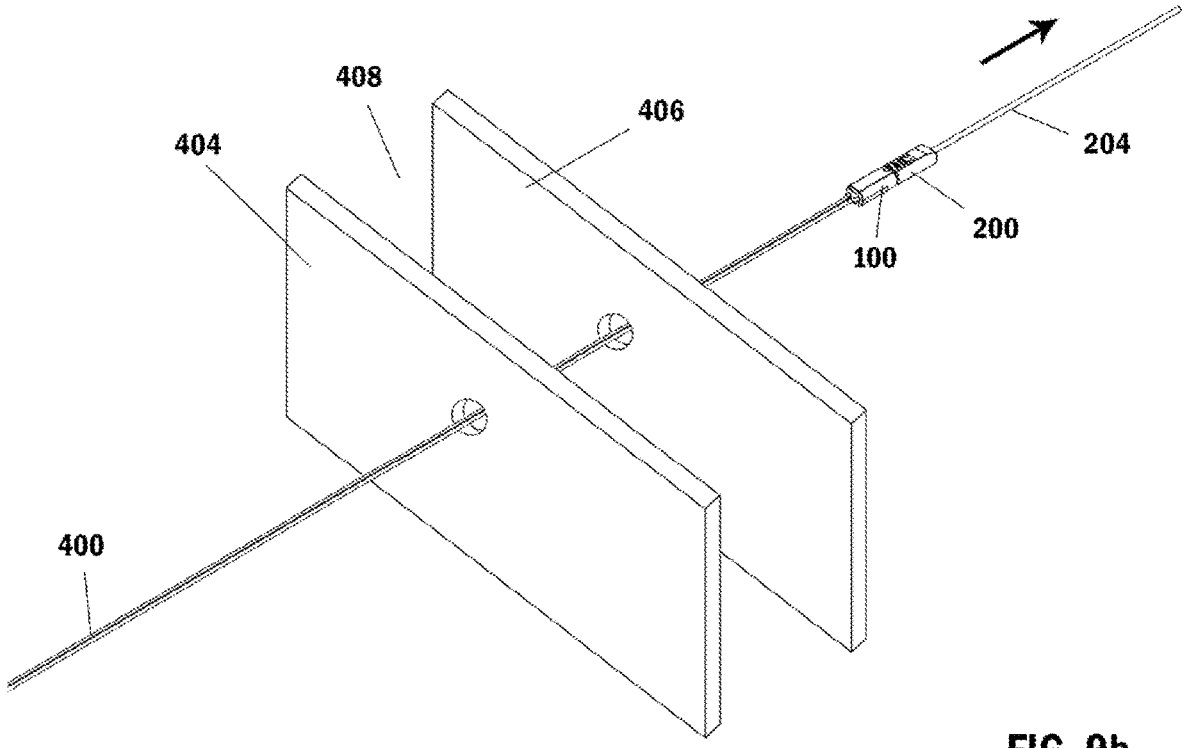
FIG. 9*b* is an isometric perspective view of a third step for using a guide rod assisted electrical quick connect device, as contemplated by the present disclosure.
Figure 10:
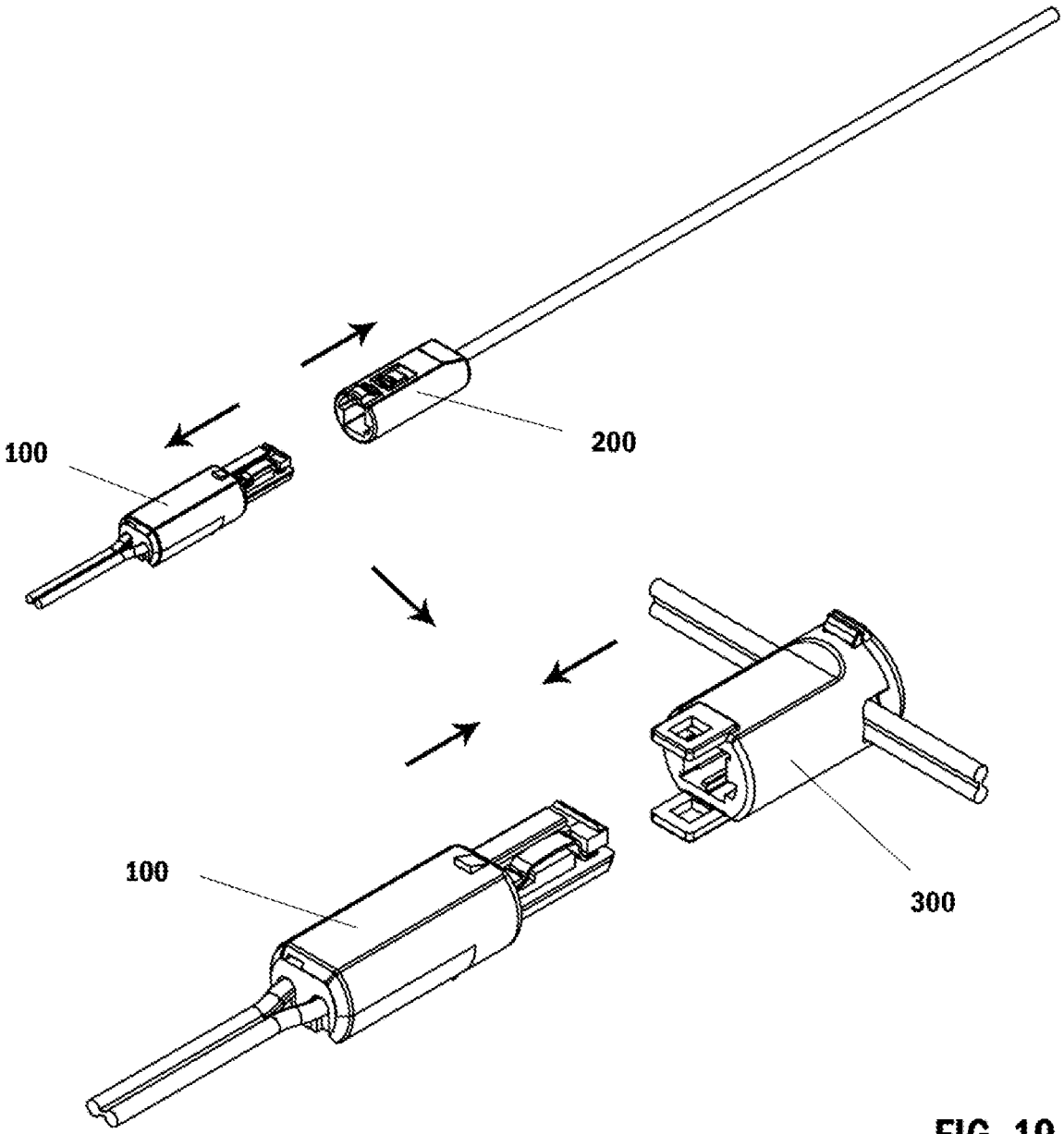
FIG. 10 is an isometric perspective view of a fourth step for using a guide rod assisted electrical quick connect device, as contemplated by the present disclosure.
Figure 11:
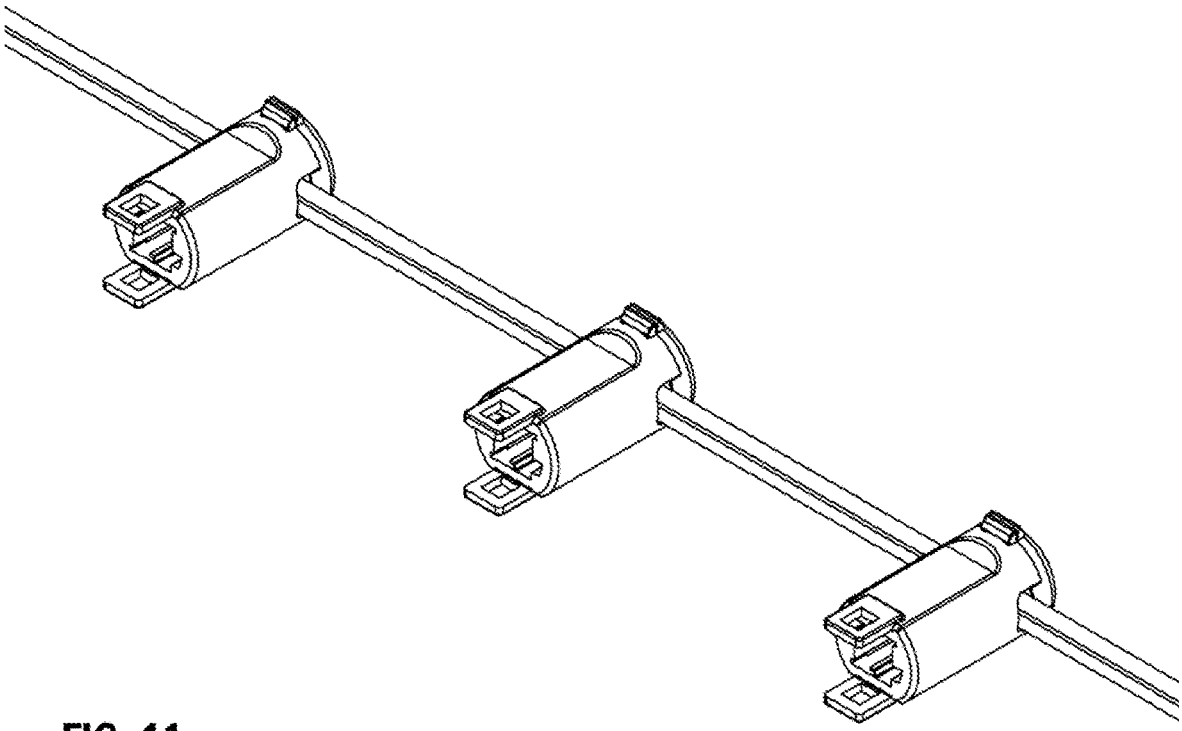
FIG. 11 is an isometric perspective view of a plurality of third connectors of a guide rod assisted electrical quick connect device, as contemplated by the present disclosure.

The illustrations of FIGS. 6-7 illustrate a female connector assembly 300, which may comprise a main body 302 having a body lid 304 generally forming an outer shell into which may be installed a plurality of electrical connections. The plurality of electrical connections of the female connector assembly 300 may comprise the electrical components and connections necessary to create an electrical socket having a connection receiver 312, and may be electrically attached to a power producer by producer-side electrical wiring 402.

The producer-side electrical wiring 402 may comprise, for example, a pair of electrical wires carrying either a power signal or a ground signal towards or away from the female connector assembly 300. In one embodiment the producer-side electrical wiring 402 may comprise a spool of electrical wiring onto which a plurality of female connector assemblies 300 are installed.

The main body 302 of the female connector assembly 300 may further comprise a spool receiver 306 into which one each of the electrical wires of the producer-side electrical wiring 402 may be inserted. The body lid 304 of the female connector assembly 300 may comprise a plurality of spool splicers that may align with the spool receiver 306 in such a way that one each of the plurality of spool splicers splices into one each of the electrical wires inserted into the spool receiver 306. The plurality of spool splicers may further be electrically attached to the plurality of electrical connections of the female connector assembly 300.

By this design the placing of electrical wires into the spool receiver 306 and the closing of the body lid 304 of the female connector assembly 300 against the main body 302 of the female connector assembly 300 creates a continuous electrical connection between the female connector assembly 300, the producer-side electrical wiring 402, and a power producer. This self-splicing design eliminates the need for a user to first strip the electrical wires before attached them to the female connector assembly 300, reducing the time requirement and complexity of installing the female connector assembly 300. In one embodiment a plurality of female connector assemblies 300 may be provided already attached to a spool of electrical wiring spaced out at regular intervals.

The female connector assembly 300 may further comprise a mechanism for reversibly connecting it to the male connector assembly 100 and preventing unintended separation of the connected components. By way of example, the female connector assembly 300 may further comprise a connector notch 310, which may be one or more notches, hooks, clamps, or other attachment mechanisms on the outer side of the main body 302 of the female connector assembly 300 which may attach onto the connector lock 112 of the male connector assembly 100 by pushing the two connectors towards each other, and which prevents the attachment mechanism from becoming separated without an intentional unlocking of the attachment mechanism by a user.

The female connector assembly 300 may further comprise a connection receiver 312, which may be an opening in the main body 302 of the female connector assembly 300 that is compatible with and complementary to the connection sender 114 of the male connector assembly 100 and receives the connection sender 114 of the male connector assembly 100.

The connection receiver 312 of the female connector assembly 300 may further comprise an electrical connection compatible with and complementary to the connection sender 114 of the male connector assembly 100, such that there is an electrical continuity between the female connector assembly 300 and the male connector assembly 100 when they are connected to each other. By this design the connecting of the female connector assembly 300 and the male connector assembly 100 creates a continuous electrical connection from a power producer, through the producer-side electrical wiring 402, through the consumer-side electrical wiring 400, and to the power consumer.

The female connector assembly 300 may further comprise a plurality of finger traction devices on its outer surface to aid a user in pushing, pulling, or squeezing the female connector assembly 300. In one embodiment a squeezing of the female connector assembly 300 may aid in disconnecting the connector notch 310 from an attachment mechanism on a second connector.

The illustrations of FIGS. 8-11 illustrate a method for using the guide rod assisted electrical quick connect device. To begin using the device the male connector assembly 100 may be first connected to the fishing tool assembly 200. The male connector assembly 100 and fishing tool assembly 200 may be advanced through a hole in an outer wall 404 through a wall spacing 408 and through a hole in an inner wall 406 using one of the plurality of guide rods 204 to allow the combination to pass through the openings without falling into the wall spacing 408. This action also serves to pull the consumer-side electrical wiring 400 through the various holes in the various walls.

The user may then access the interior aspect of the walls and disconnect the fishing tool assembly 200 from the male connector assembly 100. Finally, the user may connect the male connector assembly 100 to a female connector assembly 300, which may then be electrically connected to a power producer, thus creating an electrical circuit between the power producer and the power consumer.

In one embodiment a plurality of female connector assemblies 300 may be connected to a spool of electrical wiring so that multiple male connector assemblies 100 may be advanced through multiple holes in the walls and then quickly connected to a pre-assembled chain of female connector assemblies 300, significantly reducing the time and work load requirement for installing signage.

The guide rod assisted electrical quick connect device may be substantially constructed of any suitable material or combination of materials, but typically is constructed of a resilient material or combination of materials such that the device is resistant to damage as a result of compression, twisting, heating, or submersion in water. As an example, and without limiting the scope of the present invention, various exemplary embodiments of the guide rod assisted electrical quick connect device may be substantially constructed of one or more materials of silicone, plastic, acrylic, polycarbonate, steel, aluminum, brass, fiberglass, carbon fiber, or combinations thereof. In some embodiments the various components of the device may be coated, lined, or otherwise insulated to prevent contamination of the device. In one embodiment the material of construction may vary from one component to the next within the system.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A guide rod assisted electrical quick connect device, comprising:

a male connector assembly;

a fishing tool assembly;

a guide rod; and a female connector assembly;

wherein said male connector assembly further comprises a connection sender;

wherein said fishing tool assembly further comprises a connection receiver;

wherein said female connector assembly further comprises a connection receiver;

wherein said connection sender of said male connector assembly is complementary to said connection receiver of said fishing tool assembly;

wherein said connection sender of said male connector assembly is complementary to said connection receiver of said female connector assembly;

wherein said guide rod is reversibly attached to said fishing tool assembly;

wherein said male connector assembly further comprises a main body, a body lid, and a plurality of electrical connections;

wherein said plurality of electrical connections of said male connector assembly are contained within said main body and said body lid of said male connector assembly;

wherein said female connector assembly further comprises a main body, a body lid, and a plurality of electrical connections;

wherein said plurality of electrical connections of said female connector assembly are contained within said main body and said body lid of said female connector assembly;

wherein said male connector assembly and said female connector assembly create a continuous electrical connection when they are attached to each other; and wherein said male connector assembly and said fishing tool assembly do not create a continuous electrical connection when they are attached to each other.

2. The invention of claim 1, wherein said fishing tool assembly further comprises a set screw and a set screw receiver;

wherein said set screw is reversibly installed within said set screw receiver; and wherein said guide rod is locked into said fishing tool assembly when said set screw is installed within said set screw receiver.

3. The invention of claim 2, wherein said male connector assembly is electrically attached to a consumer-side electrical wiring.

4. The invention of claim 3, wherein said female connector assembly is electrically attached to a producer-side electrical wiring.

5. The invention of claim 4, wherein said male connector assembly is reversibly attached to said fishing tool assembly.

6. The invention of claim 4, wherein said male connector assembly is reversibly attached to said female connector assembly.

7. The invention of claim 4, wherein said a plurality of female connector assemblies are attached to a length of electrical wiring.

8. A method of using a guide rod assisted electrical quick connect device, comprising:

attaching a fishing tool assembly to a male connector assembly;

advancing said fishing tool assembly and said male connector assembly through a plurality of holes in a wall;

separating said fishing tool assembly from said male connector assembly; and attaching said female connector assembly to said male connector assembly.

9. The method of claim 8, wherein said male connector assembly is attached to a consumer-side electrical wiring; and wherein said female connector assembly is attached to a producer-side electrical wiring.

* * * * *